US012774648B1

(12) United States Patent
Fardan et al.

(10) Patent No.: US 12,774,648 B1
(45) Date of Patent: Oct. 27, 2026

(54) SYSTEMS AND METHODS FOR PRODUCING A MULTIPHASE FORMATION FLUID UTILIZING AN ESP REDUNDANCY SYSTEM

(71) Applicant: Saudi Arabian Oil Company, Dhahran (SA)

(72) Inventors: Ali Al Fardan, Al Qatif (SA); Ahmed A. Khalaf, Safwa (SA); Ammar Dhubaiki, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/193,038

(22) Filed: Apr. 29, 2025

(51) Int. Cl.
*E21B 43/12* (2006.01)
*E21B 23/02* (2006.01)
*E21B 34/08* (2006.01)

(52) U.S. Cl.
CPC ..... *E21B 43/128* (2013.01); *E21B 23/02* (2013.01); *E21B 34/08* (2013.01)

(58) Field of Classification Search
CPC ..... E21B 43/128; E21B 34/08; E21B 23/02
See application file for complete search history.

(56) References Cited

U.S. PATENT DOCUMENTS 3,786,863 A * 1/1974 Tausch ..... E21B 34/106 166/322
4,913,239 A * 4/1990 Bayh, III ..... E21B 23/14 166/66.4
11,808,122 B2 * 11/2023 Artinian ..... E21B 31/00
2014/0083712 A1 * 3/2014 Vick ..... E21B 17/023 166/381
2021/0246771 A1 * 8/2021 Ejim ..... E21B 43/128

FOREIGN PATENT DOCUMENTS

WO 2018183584 A1 10/2018

* cited by examiner

*Primary Examiner* — D. Andrews
(74) *Attorney, Agent, or Firm* — Dinsmore & Shohl LLP

(57) ABSTRACT

A method of producing a multiphase formation fluid, the method comprising producing the multiphase formation fluid to a surface collection point via a first electric submersible pump (ESP) of a transformable ESP redundancy system comprising: the first ESP, a first subsurface safety valve seated on a upper landing nipple, and a tubing string defining an upper landing nipple positioned distal to the first ESP as well as the lower landing nipple positioned proximal to the first ESP; removing the first subsurface safety valve; installing a wireline-retrievable ESP system on the lower landing nipple, the wireline-retrievable ESP system comprising: a second ESP and a second subsurface safety valve coupled to the second ESP inlet end, the subsurface second safety valve seated on the lower landing nipple as well as defining a fluid inlet to the second ESP inlet end; and producing the multiphase formation fluid via the second ESP.

19 Claims, 7 Drawing Sheets

SYSTEMS AND METHODS FOR PRODUCING A MULTIPHASE FORMATION FLUID UTILIZING AN ESP REDUNDANCY SYSTEM

FIELD

The present disclosure relates to the field of multiphase formation fluid production. More particularly, the present disclosure relates to systems and methods for producing multiphase formation fluids from a subsurface formation utilizing an electric submersible pump (ESP) redundancy system.

BACKGROUND

Electric submersible pumps (ESP) are a common method of artificial lift used to efficiently extract large quantities of multiphase formation fluids (water, oil, and gas) from hydrocarbon-bearing subsurface formations. However, ESPs may occasionally fail or wear out, necessitating maintenance often requiring the removal of the ESP and the associated tubing from the wellbore. Typically, removal of the ESP requires a 'workover' rig or vessel (onshore vs. offshore) to be requisitioned to the wellsite. Because the workover rig or vessel is often procured from a third party, maintenance on the ESP can be delayed and thereby lead to extended downtime.

SUMMARY

Accordingly, systems and methods are desired by which production can be maintained at a wellsite equipped with an ESP even when the primary ESP fails. Further, where these systems and methods still require positive intervention, it would be desirable to only require wireline or light well intervention vessels as these can be requisitioned and positioned faster than workover rigs or vessel. Embodiments herein address the aforementioned need by providing ESP redundancy systems that allow multiphase formation fluid production from a wireline-retrievable ESP after the failure of the primary ESP. Further, the ESP redundancy system provides the ability to produce from the wireline-retrievable ESP without reducing well control safety by maintaining a subsurface safety valve control on the tubing string.

Particularly, an interior of a tubing string of the primary ESP making up the ESP redundancy system may be equipped with multiple landing nipples configured to seat subsurface safety valves. When the primary ESP is operational, a subsurface safety valve (which may be wireline-retrievable) may be seated on an upper landing nipple for well control. However, when the primary ESP fails, the subsurface safety valve may be removed and swapped for a wireline-retrievable ESP, which may be installed by slickline. The wireline-retrievable ESP may be itself coupled to a subsurface safety valve acting as the inlet for the wireline-retrievable ESP, such that the wireline-retrievable ESP may be seated on a lower landing nipple. The net benefit of this arrangement may be to minimize production downtime until the primary ESP can be replaced while still ensuring that adequate well controls are maintained.

In accordance with one embodiment of the present disclosure, a transformable electric submersible pump (ESP) redundancy system may comprise an ESP comprising an ESP inlet end and a ESP outlet end, the ESP inlet end fluidly connected to the subsurface formation, a tubing string coupled to the ESP outlet end and the surface collection point, wherein an interior of the tubing string defines: an upper landing nipple positioned distal to the ESP; and a lower landing nipple positioned proximal to the ESP, and a first subsurface safety valve seated on the upper landing nipple, and wherein the subsurface formation is fluidly connected to a wellbore extending from a surface collection point to the subsurface formation.

In accordance with another embodiment of the present disclosure, a transformed electric submersible pump (ESP) redundancy system for producing a multiphase formation fluid from a subsurface formation may comprise a first ESP comprising a first ESP inlet end and a first ESP outlet end, the first ESP inlet end fluidly connected to the subsurface formation; a tubing string coupled to the first ESP outlet end and the surface collection point, wherein an interior of the tubing string defines: an upper landing nipple positioned distal to the first ESP, and a lower landing nipple positioned proximal to the first ESP; and a wireline-retrievable ESP system concentrically positioned within the tubing string, the wireline-retrievable ESP system comprising: a second ESP comprising a second ESP inlet end and a second ESP outlet end, the second ESP outlet end fluidly connected to the surface collection point, and a subsurface safety valve coupled to the second ESP inlet end, the subsurface safety valve seated on the lower landing nipple as well as defining a fluid inlet to the second ESP inlet end.

In at least one or both of the previous embodiments, a method of producing a multiphase formation fluid may comprise producing the multiphase formation fluid to a surface collection point along a wellbore extending from the surface collection point to a subsurface formation via the first electric submersible pump (ESP) of the transformable ESP redundancy system; removing the first subsurface safety valve from the tubing string; installing the wireline-retrievable ESP system on the lower landing nipple; and producing the multiphase formation fluid to the surface collection point via the second ESP of the wireline-retrievable ESP system.

Additional features and advantages of the described embodiments will be set forth in the detailed description which follows, and in part will be readily apparent to those skilled in the art from that description or recognized by practicing the described embodiments, including the detailed description which follows as well as the claims.

BRIEF DESCRIPTION OF THE DRAWINGS

The following detailed description of specific embodiments of the present disclosure can be best understood when read in conjunction with the following drawings, where like structure is indicated with like reference numerals and in which.

Figure

Figure 1:
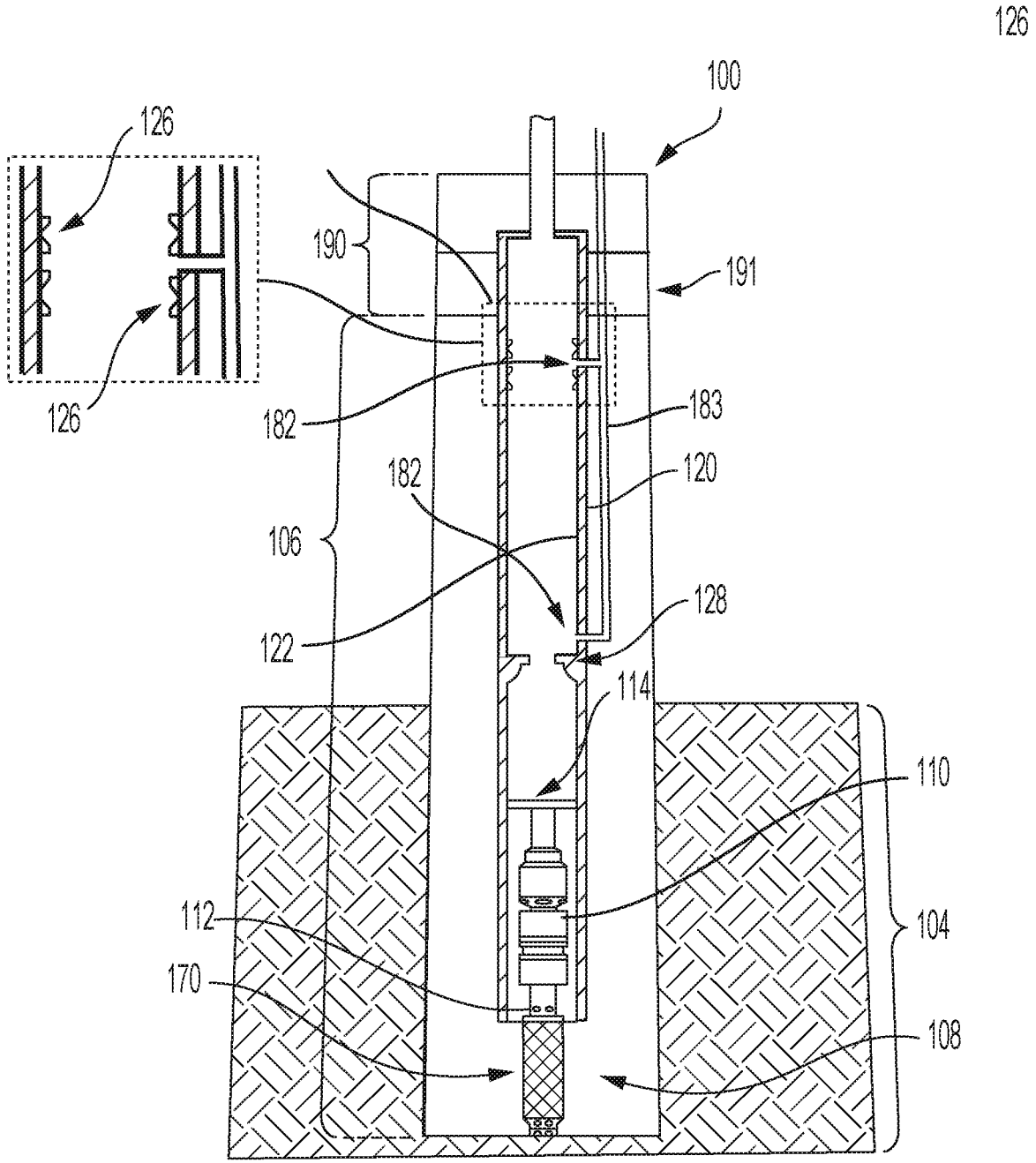
(FIG. 1 illustrates an ESP redundancy system, and particularly uncovered upper and lower landing nipples, according to embodiments herein.

For the purpose of describing the simplified schematic illustrations and descriptions of the relevant figures, the numerous potential valves, fluid delivery lines, power cables, sensors, threads, and the like that may be employed and well known to those of ordinary skill in the art of subsurface assemblies may or may not be included. It should be understood that these components are within the spirit and scope of the present embodiments disclosed. However, operational components, such as those described in the present disclosure, may be added to the embodiments described in this disclosure.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

As previously stated, embodiments described herein generally relate to multiphase formation fluid production. More particularly, embodiments herein relate to systems and methods for producing multiphase formation fluids from a subsurface formation utilizing an electric submersible pump (ESP) redundancy system. The methods and systems herein are described, in some instances, in the context of the subsurface formations of FIGS. 1-6. However, it should be understood that the methods and systems described herein may have applicability with other subsurface formations than are illustrated in FIGS. 1-6, as would be appreciated by those skilled in the art.

As used herein, the terms "downhole" and "uphole" may refer to a position within a wellbore relative to the surface, with uphole indicating direction or position closer to the surface and downhole referring to direction or position farther away from the surface. Similarly, as used herein, the terms "downward" and "upward" may refer to a position within a subterranean environment or subsurface formation relative to the surface, with upward indicating direction or position closer to the surface and downward referring to direction or position farther away from the surface.

As used herein, the term "proximal" means closer to or in the direction of an origin of an element. The term "distal" means further from the origin.

As described herein, a "subsurface formation" may refer to a body of rock that is sufficiently distinctive and continuous from the surrounding rock bodies that the body of the rock may be mapped as a distinct entity. A subsurface formation is, therefore, sufficiently homogenous to form a single identifiable unit containing similar properties throughout the subsurface formation, including, but not limited to, porosity and permeability.

As used herein, "wellbore," may refer to a drilled hole or borehole extending from the surface of the Earth down to the subsurface formation, including the openhole or uncased portion. The wellbore may form a pathway capable of permitting fluids to traverse between the surface and the subsurface formation. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore.

As used herein, a "wellbore wall" may refer to the interface through which fluid may transition between the subsurface formation and the interior of the wellbore. The wellbore wall may be unlined (that is, bare rock or formation) to permit such interaction with the subsurface formation or lined, such as by a tubular string, to prevent such interactions. The wellbore wall may also define the void volume of the wellbore.

Referring now to FIGS. 1-6, wellbore diagrams for an electric submersible pump (ESP) redundancy system 100 (also referred to herein as "system" for short) in various states of transformation for producing a multiphase formation fluid 108 are illustrated.

As shown in FIGS. 1-6, the system 100 may be positioned in a wellbore that may extend from a surface collection point 106 to a subsurface formation 104. Also as shown in FIG. 1, the subsurface formation 104 may comprise and/or contain the multiphase formation fluid 108. The multiphase formation fluid 108 may comprise a liquid phase and a gaseous phase. The liquid phase may comprise liquid hydrocarbons and/or water. The gaseous phase may comprise hydrocarbon gases and/or acid gases (such as, but not limited to hydrogen sulfide, carbon dioxide, and carbon monoxide).

As described herein, the water may be pure water or any aqueous solution such as those selected from the group consisting of formation water; filtered seawater; untreated seawater; natural salt water; brackish salt water; saturated salt water; synthetic brine; mineral waters; potable water containing one or more dissolved salts, minerals, and organic materials; non-potable water containing one or more dissolved salts, minerals, and organic materials; deionized water; tap water; distilled water; fresh water; or combinations thereof.

The subsurface formation 104, and thereby the multiphase formation fluid 108, may have a temperature of at least 30° C., such as from 30° C. to 80° C., from 80° C. to 100° C., from 100° C. to 150° C., from 150° C. to 200° C., from 200° C. to 400° C., or any combination of the previous ranges or smaller range therein, such as from 50° C. to 200° C. The subsurface formation 104, and thereby the multiphase formation fluid 108, may also have a pressure of at least 500 psi, such as from 500 psi to 1,000 psi, from 1,000 psi to 2,000 psi, from 2,000 psi to 3,000 psi, from 3,000 psi to 4,000 psi, from 4,000 psi to 6,000 psi, from 6,000 psi to 10,000 psi, or any combination of the previous ranges or smaller range therein, such as from 500 psi to 4,000 psi.

As previously stated, embodiments herein may be directed to an electric submersible pump redundancy system 100. The system 100 may comprise a first electric submersible pump 110 (ESP) and a tubing string 120. As shown in FIGS. 1-6, the first electric submersible pump 110 may comprise an electric submersible pump inlet end 112 and an electric submersible pump outlet end 114. The first electric submersible pump 110 may be coupled to the tubing string 120 by the electric submersible pump outlet end 114.

Also as illustrated in FIGS. 1-6, the electric submersible pump may further comprise a motor section, a seal section, and a pump section. The motor section may be configured to supply drive to the pump section. The pump section may be configured to lift the multiphase formation fluid 108 through the electric submersible pump. The seal section may be configured to prevent the multiphase formation fluid 108 from entering the motor section. Accordingly, the electric submersible pump may be configured to produce the multiphase formation fluid 108 from the subsurface formation 104 through the electric submersible pump inlet end 112 and through the electric submersible pump outlet end 114 to the tubing string 120.

As previously stated, and as shown in FIGS. 1-6, the system 100 may also comprise the tubing string 120. The tubing string 120 may comprise an interior having an inner diameter and an exterior having an outer diameter. In other words, the tubing string 120 may be hollow and act as a fluid conduit from one end of the tubing string 120 to another. For example, and as shown in FIGS. 1-6, the tubing string 120 may be coupled to the first electric submersible pump 110 and the surface collection point 106, such that the tubing string 120 may fluidly connect the first electric submersible pump 110 and the surface collection point 106.

As previously stated, the tubing string 120 may comprise an interior surface 122. The interior surface 122 may define an upper landing nipple 126 positioned distal to the first electric submersible pump 110 and proximal to the surface collection point 106, as well as a lower landing nipple 128 positioned proximal to the first electric submersible pump 110 and distal to the surface collection point 106. For example, and in embodiments, the upper landing nipple may be placed at a shallow depth, i.e., close to surface, such as at a depth of from 0 to 100 feet, from 100 feet to 200 feet, from 200 feet to 300 feet, from 300 feet to 500 feet, from 500 feet to 1000 feet, from 1000 feet to 2000 feet, or combinations of the previous ranges or smaller ranges therein, such as from 100 to 2000 feet.

Similarly, the upper landing nipple may be placed at a greater depth, i.e., close to the first ESP, such as at a depth of from 2500 to 3000 feet, from 3000 to 4000 feet, from 4000 feet to 6000 feet, from 6000 feet to 8000 feet, from 8000 to 14,000 feet, or combinations of the previous ranges or smaller ranges therein, such as from 2500 feet to 14,000 feet.

According to embodiments herein, the upper and lower landing nipples 126/128 may be described as nipples owing to the presence of a port 182 being defined within the first and second landing nipples 126/128.

Figure 7:
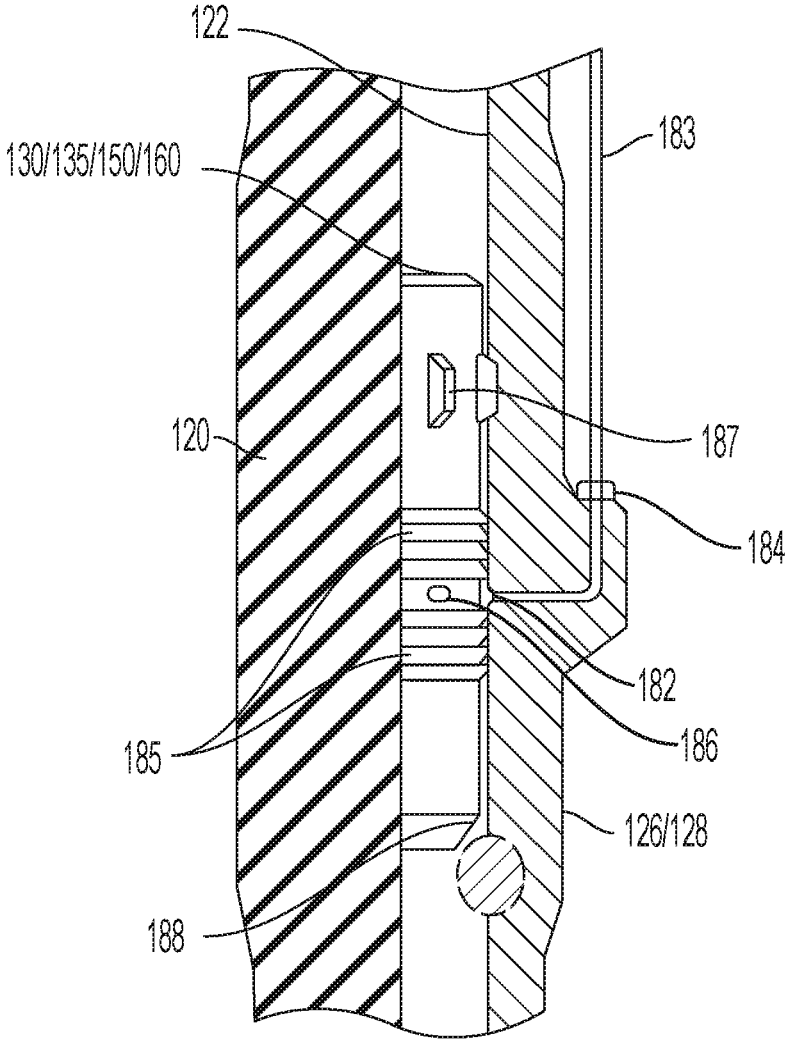
FIG. 7 illustrates a subsurface safety valve installed on a landing nipple, according to embodiments herein.

For example, and as shown in FIG. 7, the upper and lower landing nipples may comprise a port 182 extending from the interior to the exterior of the upper and lower landing nipples 126/128. Without being limited by theory, the port 182 may operate to provide a conduit for hydraulic fluid for opening or closing the subsurface safety valve, as explained in further detail herein.

Referring back to FIGS. 1-6, and as previously stated, the tubing string 120 may comprise the upper landing nipple 126 and the lower landing nipple 128. In embodiments, the upper and lower landing nipples 126/128 may be configured to seat one or more additional components for assembling the electric submersible pump redundancy system 100, which may be wireline-retrievable, such as one or more subsurface safety valves (SSV) and/or one or more protection sleeves.

Figure 2:
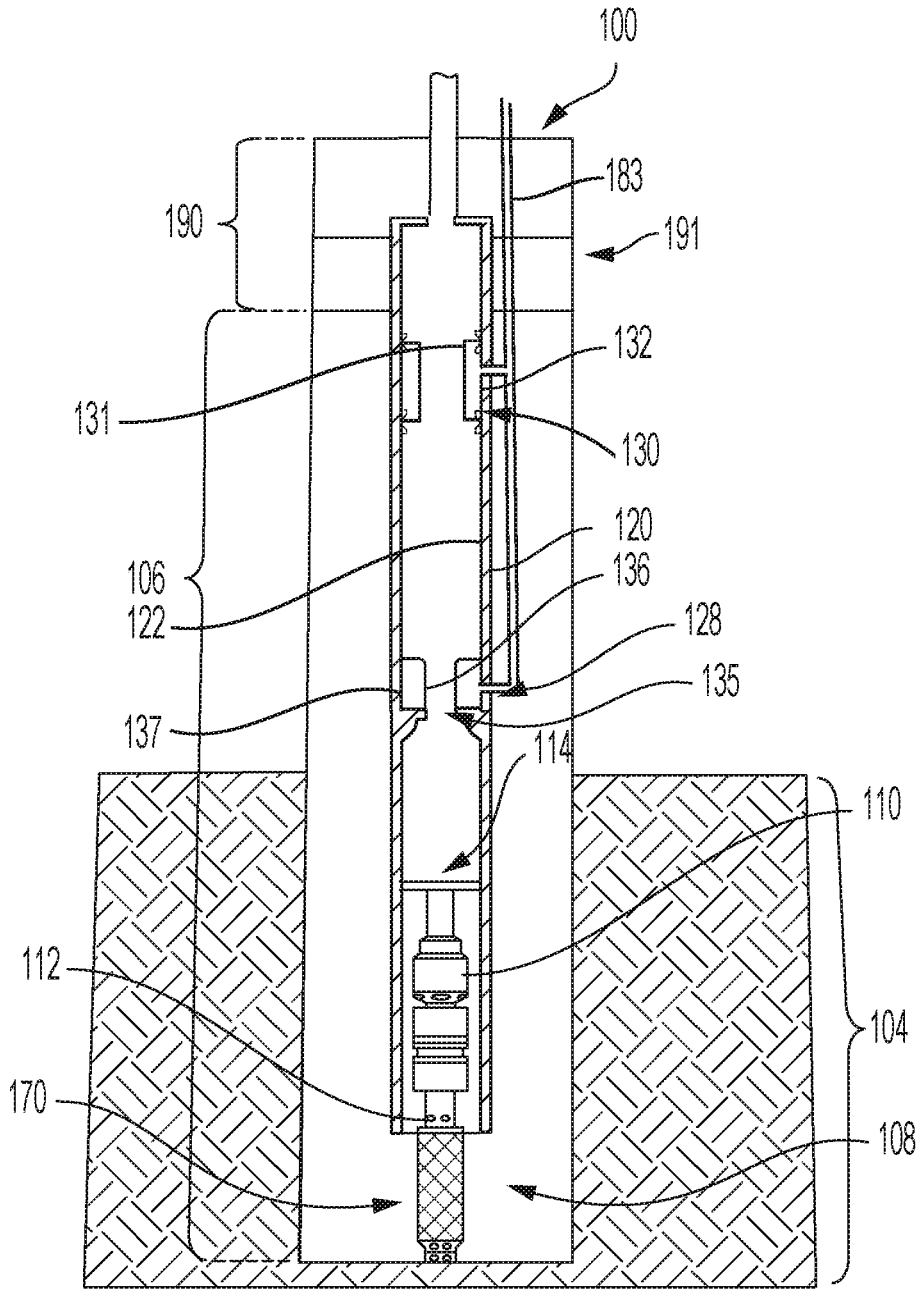
FIG. 2 illustrates the ESP redundancy system of FIG. 1, and particularly a subsurface safety valve seated on the upper landing nipple and a protection sleeve seated on the lower landing nipple, according to embodiments herein.

For example, and as shown in at least FIG. 2, a first subsurface safety valve 130 may be seated on the upper landing nipple 126. Similarly, a first protection sleeve 135 may be seated on the lower landing nipple 128. In this configuration, the first protection sleeve 135 may operate to cover up the port 182 in the lower landing nipple 128 and thereby prevent formation fluids from inadvertently entering the same, while not substantially obstructing the flow of formation fluids in the tubing string 120. Similarly, the first subsurface safety valve 130 may ensure that well control is adequately maintained.

The subsurface safety valves compatible with the systems herein are not particularly limited, and may include any wireline-retrievable safety valve known in the art. For example, illustrated in FIG. 7 is a subsurface safety valve generally according to embodiments herein. As shown in at least FIG. 7, but also variously throughout FIGS. 2, 3, 5, and 6, the subsurface safety valves, and the first subsurface safety valve 130 in particular, may comprise a first subsurface safety valve interior 131 and a first subsurface safety valve exterior 132. The first subsurface safety valve exterior 132 may be defined by a mating surface configured to engage with the upper landing nipple 126.

For example, and in embodiments, the upper landing nipple 126 may comprise a corresponding mating surface to the first subsurface safety valve exterior 132 on the interior surface 122 of the tubing string 120. In so being configured, the first subsurface safety valve 130 may be translatable along the length of the tubing string 120 until the mating surface of the first subsurface safety valve encounters the corresponding mating surface of the upper landing nipple 126. To secure the first subsurface safety valve 130 in place, the first subsurface safety valve exterior 132 may additional comprise a (first) locking mandrel 187. When actuated, (such as by rotating the first subsurface safety valve 130) the locking mandrel 187 may engage with the interior of the upper landing nipple 126 and thereby hold the first subsurface safety valve 130 in place. When the first subsurface safety valve 130 is desired to be removed, the first subsurface safety valve 130 may be de-actuated, such as by rotating the first subsurface safety valve 130 in the opposite direction, free the subsurface safety valve where it may be retrieved such as by wireline.

As previously stated, the system 100 may comprise the first protection sleeve 135, which may have a first protection sleeve interior 136 and a first protection sleeve exterior 137. The first protection sleeve 135 may also be seated on the lower landing nipple 128. For example, and in embodiments, the lower landing nipple 128 may be a no-go landing nipple having a reduced inner diameter with respect to the upper landing nipple 126's inner diameter. Similarly, the first protection sleeve exterior 137 may be defined by a (first) no-go protrusion 188 sized such that the first protection sleeve 135 cannot pass completely through the lower landing nipple 128.

In so being configured, the first protection sleeve 135 may be translatable along the length of the tubing string 120 until the second no-go protrusion 188 encounters the reduced inner dimeter of the lower landing nipple 128. Further, as the upper landing nipple 126 has a greater internal diameter than the lower landing nipple 128, the first protection sleeve 135 may be translatable past the upper landing nipple 126 but not past the lower landing nipple 128. Similar to the first subsurface safety valve 130, to secure the first protection sleeve 135 in place, the first protection sleeve exterior 137 may additional comprise a (second) locking mandrel 187, as shown in FIG. 7. When actuated, (such as by rotating the first protection sleeve 135) the locking mandrel 187 may engage with the interior of the lower landing nipple 128 and thereby hold the first protection sleeve 135 in place. When the first protection sleeve 135 is desired to be removed, the first protection sleeve 135 may be de-actuated, such as by rotating the first protection sleeve 135 in the opposite direction.

Figure 3:
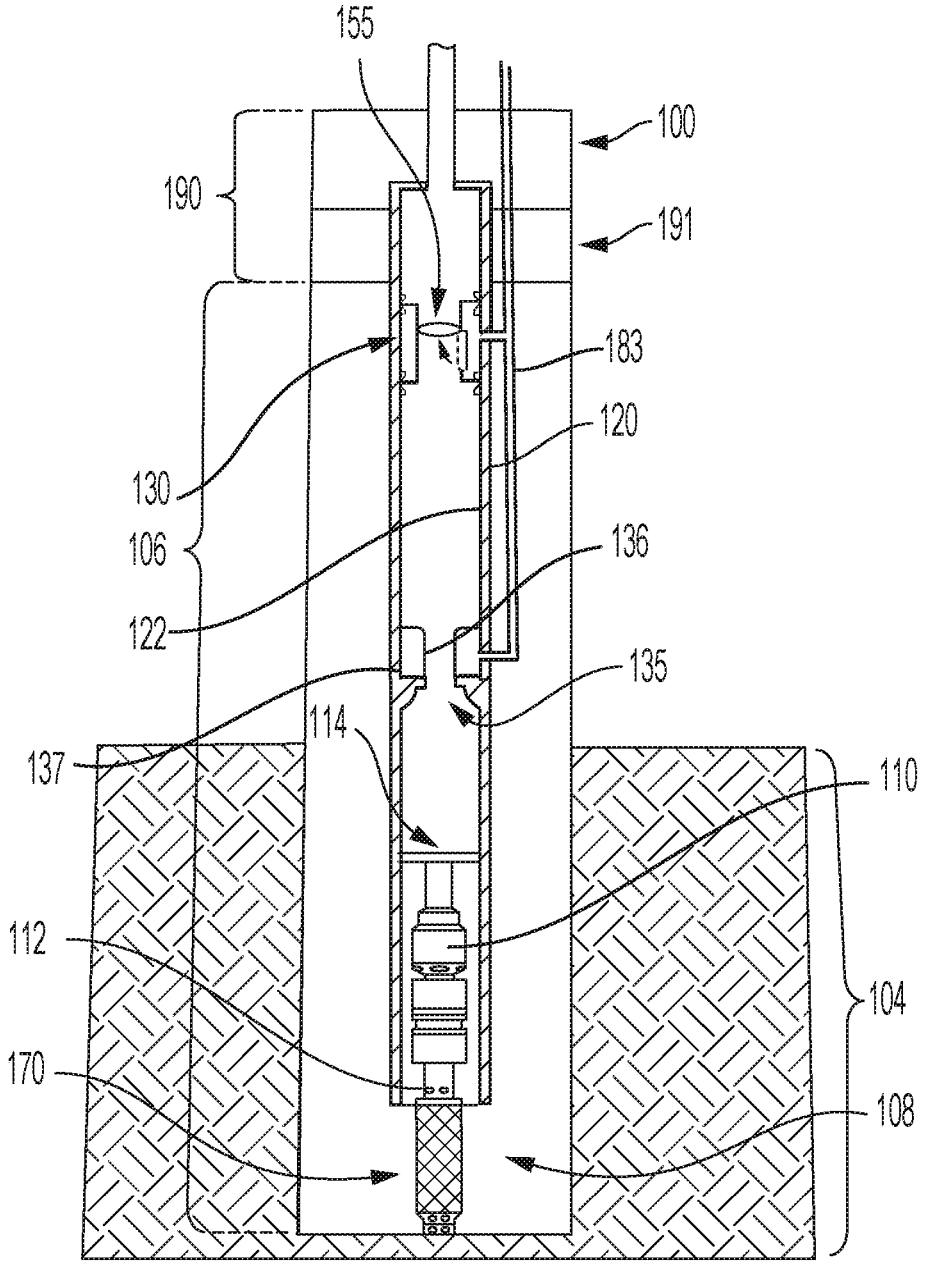
FIG. 3 illustrates the ESP redundancy system of FIGS. 1-2, and particularly the subsurface safety valve in a closed position, according to embodiments herein.

Still referring to FIG. 7, and as previously stated, the first subsurface safety valve 130 may be installed as a well control mechanism. Particularly, the first subsurface safety valve 130, and the subsurface safety valves in general as described herein, may comprise a flapper mechanism 155, as shown in FIGS. 2-3, that is configured to be closed at rest and thereby obstruct fluid flow through the subsurface safety valve. The subsurface safety valve may be configured to be closed at rest through a variety of means, but most commonly through a biasing mechanism such as, but not limited to, a spring. Accordingly, to offset the biasing means and force open the flapper mechanism 155, an opposite force may be applied against the biasing means. This opposite force is most commonly a hydraulic fluid, but other means are possible and contemplated. Particularly, hydraulic fluid may be delivered from a hydraulic pump (not illustrated) coupled to one or more hydraulic fluid delivery lines 183 coupled to a port 182 of the landing nipple through a port coupling adapter 184 on the exterior of the landing nipple. The hydraulic fluid may then be guided into an aperture 186 of the subsurface safety valve leading to an inner chamber (not illustrated) which when pressurized compresses the biasing means and forces open the flapper mechanism 155. Further, to prevent the hydraulic fluid from co-mingling with the formation fluid in the tubing string 120, a seal pair 185 may be provided on the exterior of the subsurface safety valve, thereby isolating the port 182 and aperture 186 from the remainder of the tubing string 120. Accordingly, the combination of the no-go protrusion 188, locking mandrel 187, and seal pair 185 may ensure that the subsurface safety valve is located and maintained at the appropriate position to receive the hydraulic fluid and avoid exposure of the port 182.

In comparison, the first protection sleeve 135, and the protection sleeves described herein in general, may operate to form a seal over the port 182, preventing ingress of formation fluids into the port 182 or egress of hydraulic fluid into the wellbore.

Figure 4:
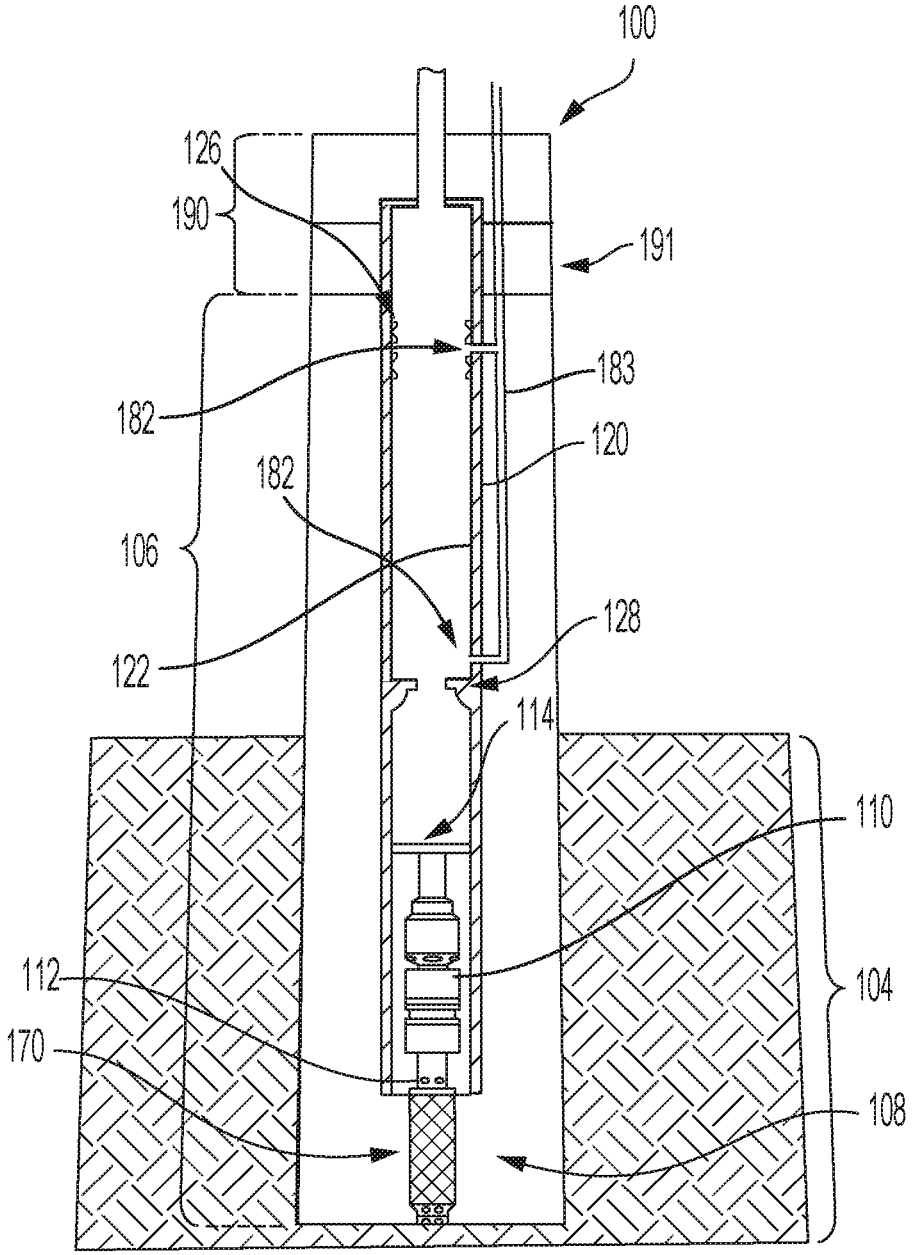
FIG. 4 illustrates the ESP redundancy system of FIGS. 1-3, and particularly with the subsurface safety valve and the protection sleeve removed, according to embodiments herein.

As previously stated, the electric submersible pump redundancy system 100 may be configured to be adjustable between a transformable configuration and a transformed position, depending on whether the first electric submersible pump 110 is operating as intended. For example, and as illustrated in FIG. 4, the first subsurface safety valve 130 and/or the first protection sleeve 135 may be removed from the tubing string 120 to install a wireline-retrievable electric submersible pump system 140 for addressing the first electric submersible pump 110's failure, the wireline-retrievable electric submersible pump system 140 of which may be installed concentrically within the tubing string 120.

Figure 5:
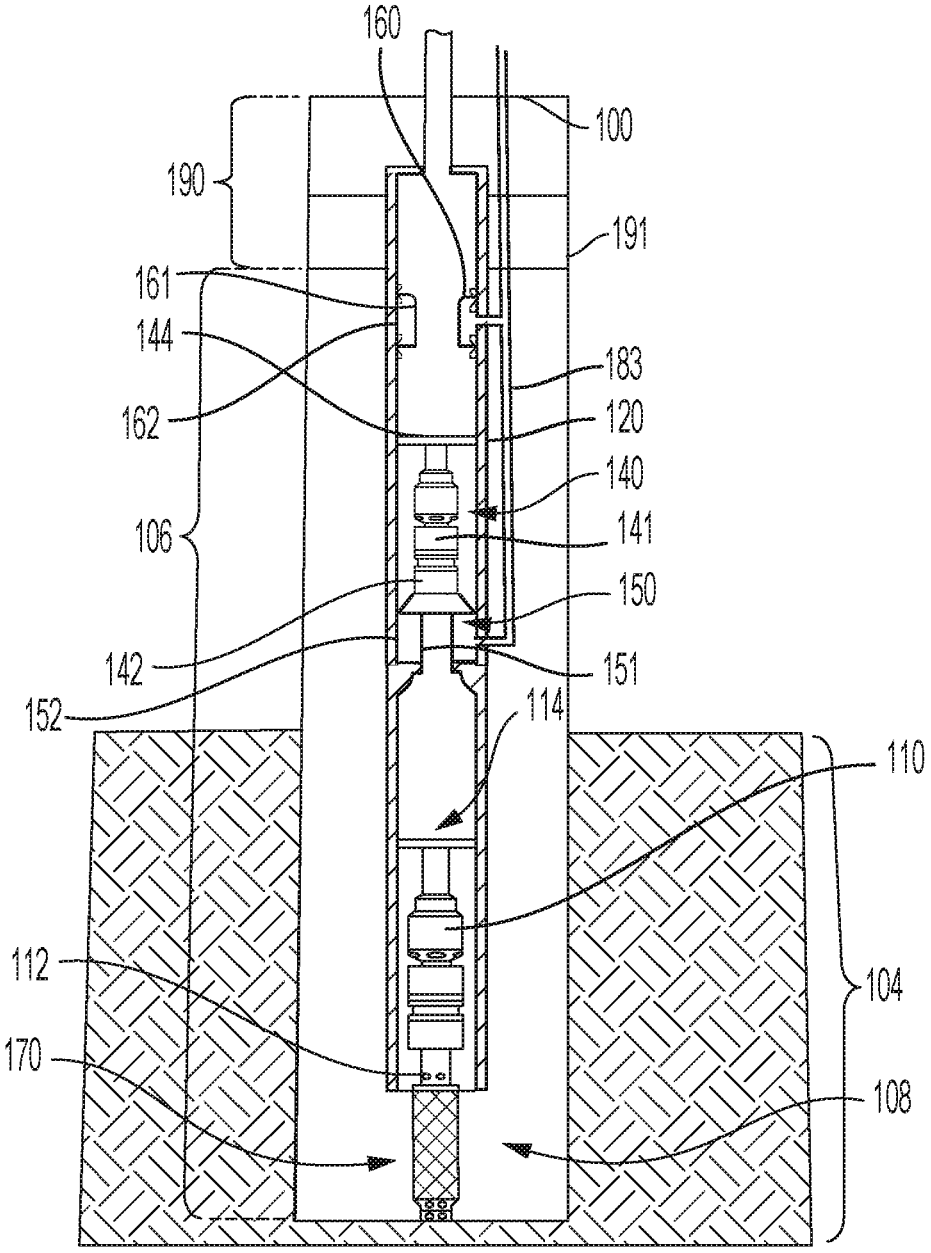
FIG. 5 illustrates the ESP redundancy system of FIGS. 1-4, and particularly with a protection sleeve seated on the upper landing nipple and a wireline-retrievable ESP seated on the lower landing nipple, according to embodiments herein.
Figure 6:
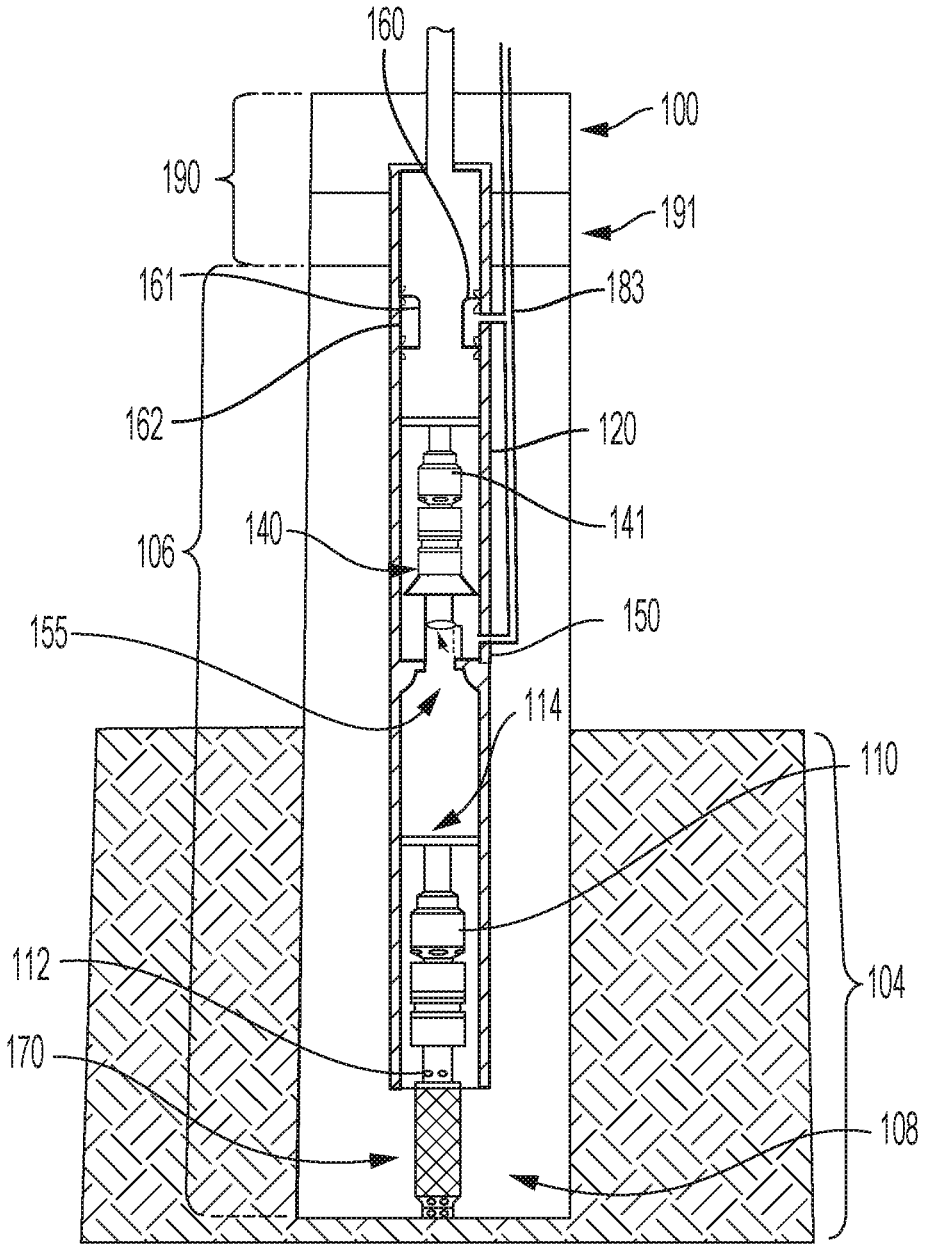
FIG. 6 illustrates the ESP redundancy system of FIGS. 1-5, and particularly with the subsurface safety valve in a closed position, according to embodiments herein.

Particularly, as shown in FIGS. 5-6, the wireline-retrievable electric submersible pump system 140 may comprise a second subsurface safety valve 150 and a second electric submersible pump 141, the second electric submersible pump 141 similarly comprising a second electric submersible pump inlet end 142 and a second electric submersible pump outlet end 144. The second subsurface safety valve 150 may in turn be coupled to the second electric submersible pump inlet end 142, such that the second subsurface safety valve 150 defines a fluid inlet to the second electric submersible pump 141.

The second subsurface safety valve 150, similar to the first subsurface safety valve 130, may comprise a second subsurface safety valve interior 151 and a second subsurface safety valve exterior 152. However, similar to the first protection sleeve 135, the second subsurface safety valve exterior 152 may be defined by a (second) no-go protrusion 188 sized such that the second subsurface safety valve 150 cannot pass completely through the lower landing nipple 128. Accordingly, the wireline-retrievable electric submersible pump system 140 may in turn be secured in the wellbore by seating the second subsurface safety valve 150 on the lower landing nipple 128. In so being configured, the second subsurface safety valve 150 may act both as a fluid inlet to the second electric submersible pump 141 and a substitute well control for the first subsurface safety valve 130 removed prior to installation of the wireline-retrievable electric submersible pump system 140.

Further, in at least some embodiments, a second protection sleeve 160 may be seated on the upper landing nipple 126, which may be similar or identical to the first protection sleeve 135, but sized instead for the upper landing nipple 126. Particularly, the second protection sleeve 160 may comprise a second protection sleeve interior 161 and a second protection sleeve exterior 162.

However, similar to the first subsurface safety valve 130, the second protection sleeve may be defined by a mating surface configured to engage with the corresponding mating surface of the upper landing nipple 126.

As previously stated, the second subsurface safety valve 150 and the second protection sleeve 160 may be similar to the first subsurface safety valve 130 and the first protection sleeve 135 in at least some aspects. Accordingly, to secure the second subsurface safety valve 150 and/or the second protection sleeve 160 in place, the exteriors of the second subsurface safety valve 150 and the second protection sleeve 160 may similarly comprise (third and fourth) locking mandrels 187, respectively, as shown in FIG. 7 for example. Further, the second subsurface safety valve 150 may comprise the flapper mechanism 155, the aperture 186, and the seal pair 185, and the lower landing nipple 128 may comprise the port 182 and the one or more hydraulic delivery lines 183.

In at least some embodiments, the system 100 may comprise a gas separator 170, although this is not required. The gas separator 170 may comprise a multiphase formation fluid 108 inlet, a gaseous phase outlet, and a liquid phase outlet, the liquid phase outlet coupled to the inlet end of the first electric submersible pump 110. The gas separator 170 may include, but may not be limited to, a centrifugal gas separator 170, a turbulent-flow gas separator 170, or any other category of gas separator 170 known in the art. Accordingly, without being limited by theory, the gas separator 170 may be configured to separate at least a portion of the gaseous phase in the multiphase formation fluid 108 to produce the gaseous phase out the gaseous phase outlet and the liquid phase out the liquid phase outlet. The liquid phase may then enter the electric submersible pump inlet end 112 where it may be lifted by the pump section to the electric submersible pump outlet end 114.

As previously stated, the electric submersible pump redundancy system 100 may be positioned in a wellbore fluidly connecting the subsurface formation 104 to the surface collection point 106. The surface collection point 106 may in turn comprise a wellhead 190 and a tubing hanger 191, the wellhead 190 configured to accept the tubing string 120 and the tubing hanger 191 configured to suspend the tubing string 120, as well as any associated components, from the wellhead 190. The wellhead 190 may also comprise a wellhead flange (not illustrated), which may be fluidly connected and coupled to a first length of pipe (not illustrated). The first length of pipe may in turn be fluidly connected and coupled to a downstream choke valve. A third length of pipe may in turn fluidly couple the downstream choke valve to a treatment facility. The treatment facility may comprise one or more hydrocarbon refining units, such as separators, reactors, dehydration systems, sweetening systems, or the like.

As previously described, the system 100 may include the first electric submersible pump 110 and/or the second electric submersible pump 141. However, the system 100 may additionally comprise a power source positioned at the surface collection point 106 to provide power to the first electric submersible pump 110, the second electric submersible pump 141, or both. Additionally, system 100 may also comprise one or more power cables electrically coupling the power source to the first electric submersible pump 110, the second electric submersible pump 141, or both.

As previously stated, the system 100 may comprise the one or more power cables extending from the power source to the first electric submersible pump 110, the second electric submersible pump 141, or both. As to the first electric submersible pump 110, the system 100 may also comprise a plurality of tubing claims spaced along the length of the tubing string 120. The plurality of tubing clamps may couple the one or more cables to the tubing sting, thereby securing the one or more power cables in a fixed line position and preventing the one or more power cables from wrapping around the tubing string 120 and potentially being damaged. As to the second electric submersible pump 141, the one or more power cables may be freely suspended within the tubing, extending from the power source to the second electric submersible pump 141.

As previously stated, embodiments herein may also be directed to methods for producing the multiphase formation fluid 108. The method may initially comprise installing any of the electric submersible pump redundancy systems 100 previously mentioned into the wellbore, such as illustrated in FIGS. 1-3. The method may then comprise producing the multiphase formation fluid 108 to the surface collection point 106 via the first electric submersible pump 110 of the electric submersible pump redundancy system 100. The method may then comprise observing a reduction in production of multiphase formation fluids by the first electric submersible pump 110.

Accordingly, after observing the reduction in production, the electric submersible pump redundancy system 100 may be transformed/converted to the transformed electric submersible pump redundancy system 100 by removing the first protection sleeve 135 (if the first protection sleeve 135 is present); removing the first subsurface safety valve 130 from the tubing string 120 and installing the wireline-retrievable electric submersible pump system 140 on the lower landing nipple 128, as shown for example by FIGS. 3-6, which may include installing the second protection sleeve 160 on the upper landing nipple 126 (if the second protection sleeve 160 is desired to be added).

After the wireline-retrievable electric submersible pump system 140 is installed, the method may then comprise producing the multiphase formation fluid 108 to the surface collection point 106 via the second electric submersible pump 141 of the wireline-retrievable electric submersible pump system 140.

In embodiments, the aforementioned production step may continue until the workover rig or vessel arrives to pull the first electric submersible pump 110 and tubing string 120. At that point, the method may further comprise removing the wireline-retrievable electric submersible pump system 140 from the tubing string 120; removing the second protection sleeve 160 from the tubing string 120 (if the second protection sleeve 160 is present); and removing the tubing string 120, and thereby the first electric submersible pump 110, from the wellbore.

Throughout this disclosure ranges are provided. It is envisioned that each discrete value encompassed by the ranges are also included. Additionally, the ranges which may be formed by each discrete value encompassed by the explicitly disclosed ranges are equally envisioned.

It is also noted that recitations herein of "at least one" component, element, etc., should not be used to create an inference that the alternative use of the articles "a" or "an" should be limited to a single component, element, etc. The singular forms "a," "an" and "the" include plural referents, unless the context clearly dictates otherwise.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising." It is noted that the use of the terms "having" or "including", or grammatical variations thereof, in this disclosure should also be interpreted in like manner as the more commonly used open-ended preamble term "comprising".

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation.

Having described the subject matter of the present embodiments herein in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present embodiments including, but not limited to, embodiments defined in the appended claims. More specifically, although some aspects of the present embodiments are identified herein as preferred or particularly advantageous, it is contemplated that the present embodiments is not necessarily limited to these aspects.

What is claimed is:

1. A method of producing a multiphase formation fluid, the method comprising:

producing the multiphase formation fluid to a surface collection point along a wellbore extending from the surface collection point to a subsurface formation, the multiphase formation fluid produced via a first electric submersible pump (ESP) of a transformable ESP redundancy system comprising:

the first ESP comprising a first ESP inlet end and a first ESP outlet end, the first ESP inlet end fluidly connected to the subsurface formation, a tubing string coupled to the first ESP outlet end and the surface collection point, wherein an interior of the tubing string defines an upper landing nipple positioned distal to the first ESP, as well as a lower landing nipple positioned proximal to the first ESP, and a first subsurface safety valve seated on the upper landing nipple;

removing the first subsurface safety valve from the tubing string;

installing a wireline-retrievable ESP system on the lower landing nipple, the wireline-retrievable ESP system comprising:

a second ESP comprising a second ESP inlet end and a second ESP outlet end, the second ESP outlet end fluidly connected to the surface collection point, and a second subsurface safety valve coupled to the second ESP inlet end, the subsurface second safety valve seated on the lower landing nipple as well as defining a fluid inlet to the second ESP inlet end; and producing the multiphase formation fluid to the surface collection point via the second ESP of the wireline-retrievable ESP system.

2. The method of claim 1, further comprising:

removing the wireline-retrievable ESP system from the tubing string; and removing the tubing string, and thereby the first ESP, from the wellbore.

3. The method of claim 2, further comprising installing a second transformable ESP redundancy system into the wellbore.

4. The method of claim 1, wherein:

the transformable ESP redundancy system further comprises a first protection sleeve seated on the lower landing nipple; and the method further comprises removing the first protection sleeve from the tubing string between observing a reduction in production of multiphase formation fluids and removing the first subsurface safety valve.

5. The method of claim 4, further comprising installing a second protection sleeve on the upper landing nipple after removing the first subsurface safety valve from the tubing string.

6. The method of claim 1, wherein:

an exterior of the first subsurface safety valve is defined by a mating surface configured to engage with the upper landing nipple; and the upper landing nipple comprises a corresponding mating surface to the mating surface of the first subsurface safety valve.

7. The method of claim 6, wherein:

the lower landing nipple is a no-go landing nipple having a reduced inner diameter with respect to the upper landing nipple's inner diameter;

the transformable ESP redundancy system further comprises a first protection sleeve seated on the lower landing nipple;

an exterior of the first protection sleeve is defined by a first no-go protrusion sized such that the first protection sleeve cannot pass completely through the lower landing nipple; and the method further comprises removing the first protection sleeve from the tubing string between observing a reduction in production of multiphase formation fluids and removing the first subsurface safety valve.

8. The method of claim 7, wherein an exterior of the second subsurface safety valve is defined by a second no-go protrusion sized such that the second subsurface safety valve of the wireline-retrievable ESP system cannot pass completely through the lower landing nipple.

9. The method of claim 8, further comprising installing a second protection sleeve on the upper landing nipple after removing the first subsurface safety valve from the tubing string, wherein:

an exterior of the second protection sleeve is defined by a mating surface configured to engage with the corresponding mating surface of the upper landing nipple.

10. The method of claim 9, wherein:

an exterior of the first subsurface safety valve further comprises a first locking mandrel configured to engage with the upper landing nipple;

an exterior of the first protection sleeve further comprises a second locking mandrel configured to engage with the lower landing nipple;

an exterior of the second subsurface safety valve comprises a third locking mandrel configured to engage with the lower landing nipple; and an exterior of the second protection sleeve further comprises a fourth locking mandrel configured to engage with the upper landing nipple.

11. A transformable electric submersible pump (ESP) redundancy system for producing a multiphase formation fluid from a subsurface formation, wherein:

the subsurface formation is fluidly connected to a wellbore extending from a surface collection point to the subsurface formation; and the system comprises an ESP comprising an ESP inlet end and a ESP outlet end, the ESP inlet end fluidly connected to the subsurface formation, a tubing string coupled to the ESP outlet end and the surface collection point, wherein an interior of the tubing string defines:

an upper landing nipple positioned distal to the ESP, the upper landing nipple comprising an upper landing nipple port; and a lower landing nipple positioned proximal to the ESP, the lower landing nipple comprising a lower landing nipple port, a first subsurface safety valve seated on the upper landing nipple, and a protection sleeve seated on the lower landing nipple, the protection sleeve covering up the lower landing nipple port, wherein the upper landing nipple port is fluidly connected to the lower landing nipple port through a hydraulic fluid delivery line.

12. The system of claim 11, wherein:

an exterior of the first subsurface safety valve is defined by a mating surface configured to engage with the upper landing nipple; and the upper landing nipple comprises a corresponding mating surface to the mating surface of the first subsurface safety valve.

13. The system of claim 12, wherein:

the lower landing nipple is a no-go landing nipple having a reduced inner diameter with respect to the upper landing nipple's inner diameter; and an exterior of the protection sleeve is defined by a no-go protrusion sized such that the protection sleeve cannot pass completely through the lower landing nipple.

14. The system of claim 13, wherein:

an exterior of the first subsurface safety valve further comprises a first locking mandrel configured to engage with the upper landing nipple; and an exterior of the protection sleeve further comprises a second locking mandrel configured to engage with the lower landing nipple.

15. A transformed electric submersible pump (ESP) redundancy system for producing a multiphase formation fluid from a subsurface formation, wherein:

the subsurface formation is fluidly connected to a wellbore extending from a surface collection point to the subsurface formation; and the system comprises:

a first ESP comprising a first ESP inlet end and a first ESP outlet end, the first ESP inlet end fluidly connected to the subsurface formation;

a tubing string coupled to the first ESP outlet end and the surface collection point, wherein an interior of the tubing string defines:

an upper landing nipple positioned distal to the first ESP, the upper landing nipple comprising an upper landing nipple port; and a lower landing nipple positioned proximal to the first ESP, the lower landing nipple comprising a lower landing nipple port; and a wireline-retrievable ESP system concentrically positioned within the tubing string, the wireline-retrievable ESP system comprising:

a second ESP comprising a second ESP inlet end and a second ESP outlet end, the second ESP outlet end fluidly connected to the surface collection point, and a subsurface safety valve coupled to the second ESP inlet end, the subsurface safety valve seated on the lower landing nipple as well as defining a fluid inlet to the second ESP inlet end, and a protection sleeve seated on the lower landing nipple, the protection sleeve covering up the lower landing nipple port, wherein the upper landing nipple port is fluidly connected to the lower landing nipple port through a hydraulic fluid delivery line.

16. The system of claim 15, wherein:

the lower landing nipple is a no-go landing nipple having a reduced inner diameter with respect to the upper landing nipple's inner diameter; and an exterior of the subsurface safety valve is defined by a no-go protrusion sized such that the subsurface safety valve cannot pass completely through the lower landing nipple.

17. The system of claim 15, wherein:

an exterior of the protection sleeve is defined by a mating surface configured to engage with the upper landing nipple; and the upper landing nipple comprises a corresponding mating surface to the mating surface of the protection sleeve.

18. The system of claim 17, wherein:

the lower landing nipple is a no-go landing nipple having a reduced inner diameter with respect to the upper landing nipple's inner diameter; and an exterior of the subsurface safety valve is defined by a no-go protrusion sized such that the subsurface safety valve cannot pass completely through the lower landing nipple.

19. The system of claim 18, wherein:

an exterior of the subsurface safety valve further comprises a third locking mandrel configured to engage with the lower landing nipple; and an exterior of the protection sleeve further comprises a fourth locking mandrel configured to engage with the upper landing nipple.

* * * * *